United States Patent [19]

Orthey, Jr. et al.

[11] Patent Number: 5,052,259

[45] Date of Patent: Oct. 1, 1991

[54] CHORDED ZITHER

[76] Inventors: George F. Orthey, Jr.; Mary L. Orthey, both of R.D. 1, Box 34A, Newport, Pa. 17074

[21] Appl. No.: 525,128

[22] Filed: May 17, 1990

[51] Int. Cl.[5] ..... G10D 1/12

[52] U.S. Cl. ..... 84/288

[58] Field of Search ..... 84/285, 286, 287, 288, 84/289, 290, 318

[56] References Cited

U.S. PATENT DOCUMENTS

| | | | |
|---|---|---|---|
| 530,369 | 12/1894 | Utt | 84/287 |
| 534,175 | 2/1895 | Roos | 84/287 |
| 541,352 | 6/1895 | Govan et al. | 84/287 |
| 551,254 | 12/1895 | Brand | 84/287 |
| 634,142 | 10/1899 | Heymann | 84/287 |
| 674,028 | 5/1901 | Stewart | 84/287 |
| 753,867 | 3/1904 | Ford | 84/287 |
| 757,890 | 4/1904 | Cruger | 84/287 |
| 1,097,048 | 5/1914 | Reynolds | 84/287 |
| 3,237,503 | 3/1966 | Peterson, Jr. et al. | 84/287 |
| 3,401,586 | 9/1968 | Peterson, Jr. | 84/287 |
| 3,499,357 | 3/1970 | Peterson, Jr. | 84/287 X |

*Primary Examiner*—Brian W. Brown

*Attorney, Agent, or Firm*—Howson & Howson

[57] ABSTRACT

A chromatic chorded zither is provided with at least one auxiliary damper comprising a rigid bar having string-engaging damping pads for converting the instrument for play in a diatonic scale. In one version of the instrument, retainers are provided on the chord bar housing for removably mounting the auxiliary damper alongside one of said chord bars, with the damping pads held in engagement with predetermined strings. In another version, the auxiliary damper bar has a tongue which fits into an opening of the chord bar housing. The damping pads of the auxiliary damper are arranged in a pattern to mute all strings of the instrument other than those corresponding to the diatonic scale for a particular key. With a set of several auxiliary dampers, the chromatic instrument can be converted to play in any one of several diatonic keys. The damper bars can be readily installed or removed with one hand, and take up very little room.

7 Claims, 4 Drawing Sheets

34
18

14
60
5
12
22
10
32
38
16
30
24
20
58
28
26
5
36
40

36
20
43

92

52
44
48

45
50
56
54
46

CHORDED ZITHER

BRIEF SUMMARY OF THE INVENTION

This invention relates to stringed musical instruments, and in particular to improvements in chorded zithers, whereby a chromatic instrument can be readily converted to any one of several diatonic instruments.

A chorded zither is an instrument comprising a hollow body having a set of parallel strings stretched across a resonating face and an assembly of side-by-side, individually depressible chord bars, each having multiple damping pads of felt or similar material, for selectively muting groups of strings when each chord bar is depressed. The strings are tuned to the notes of a musical scale. When a chord bar is depressed, the strings which are not muted correspond to the notes of a chord. Thus, when strings of the instrument are manually plucked or strummed with a particular chord bar depressed, a musical chord is produced.

The following United States patents illustrate musical instruments of the chorded zither type:

| | |
|---|---|
| 530,369 | Utt |
| 534,175 | Roos |
| 541,352 | Govan et al. |
| 634,142 | Heymann |
| 674,028 | Stewart |
| 753,867 | Ford |
| 757,890 | Cruger |
| 1,097,048 | Reynolds et al. |
| 3,237,503 | Peterson, Jr. et al. |
| 3,401,586 | Peterson, Jr. et al. |
| 3,499,357 | Peterson, Jr. et al. |

Chorded zithers are normally produced in one of several possible configurations.

A first type of instrument is the chromatic instrument, which is capable of producing, in each octave, all of the notes in the chromatic scale, i.e. C, C#, D, D#, E, F, F#, G, G#, A, A#, B and C.

A second type of instrument is the diatonic instrument, which produces, in each octave, only the notes of the diatonic scale for the key in which the instrument is tuned. For example in an instrument tuned to the key of C, only the notes C, D, E, F, G, A and B can be produced in each octave. The accidental notes are omitted. Similarly, for an instrument tuned to the key of G, the notes G, A, B, C, D, E and F# can be produced in each octave. Again accidental notes are omitted.

Chromatic and diatonic instruments are played using different techniques, and the diatonic instruments are especially desirable for playing certain categories of music, such as "fast fiddle" music, for example. Especially with diatonic playing techniques, there are frequent occasions for plucking or strumming strings or combinations of strings while none of the chord bars is depressed. To eliminate undesired tones resulting from plucking or strumming of unintended strings, or from sympathetic vibration of unintended strings, a diatonic instrument either omits the unnecessary strings altogether, or deactivates the unnecessary strings by means of locking dampers.

One variation on the diatonic chorded zither is an instrument designed to be played in three diatonic keys. It contains chord bars for playing the scales of the three keys and also contains three lock bars, i.e. lockable damper bars, one for each key. The purpose of the lock bars is to remove the unnecessary notes for each key, thereby enabling the instrument to be played in true diatonic form. This instrument cannot be played chromatically, and is typically limited to the keys G, D and A or the keys F, C and G.

Another variation of the chorded zither is an instrument in which the entire set of chord bars can be removed and replaced by another set in order to change from one key to another.

Still other variations, in which chord bars are made longitudinally movable for the purpose of key changes, are exemplified by several of the patents listed above.

A single chorded zither, whether of the chromatic or diatonic type, weighs approximately ten to twelve pounds. Many performers, as well as casual players, wishing to have the versatility of playing chromatically as well as diatonically in several keys, carry as many as four to seven instruments.

The variations on the chorded zither provide a partial solution to the problem of versatility. However, the instrument having a completely replaceable set of chord bars, and the instruments having longitudinally movable chord bars, are somewhat clumsy and complex. Especially in the case of the instrument in which the chord bars are replaced, a significant amount of time is required for changing from one set of chord bars to another.

A chromatic chorded zither typically contains approximately three octaves of strings. When the space required for plucking or strumming the shorter strings is taken into account, the space available for the chord bar system is limited to approximately six inches, measured in the direction of the lengths of the strings. This space accommodates no more than twenty one chord bars as a practical matter. If the chord bars include major, minor and seventh chords for each key, the instrument will accommodate as many as seven keys. However, if, as in the case of the three key diatonic instrument, a lockable damper bar is provided for each available key, the six inch space will accommodate only five keys, there being in that space fifteen chord bars, and five lockable damper bars.

The principal object of this invention is to provide a simple device for temporarily converting a chromatic chorded zither to a diatonic instrument in any one of the several keys contained in the chromatic instrument, without sacrificing space available for chord bars. A further object of the invention is to enable a musician to change rapidly and easily from the chromatic configuration to a diatonic configuration and back to the chromatic configuration, and to change rapidly and easily from one diatonic scale to another. Still a further object of the invention is to provide a simple system for retrofitting existing chromatic instruments so that they can be rapidly converted to any of several diatonic scales.

In accordance with the invention, a chromatic chorded zither is provided with at least one auxiliary damper comprising a rigid bar having string-engaging damping pads mounted thereon, and mounting means for removably mounting the auxiliary damper alongside one of said chord bars of the instrument, with the damping pads held by the mounting means in engagement with predetermined strings. The damping pads of the auxiliary damper are preferably arranged in a pattern to mute all of the strings of the set of strings on the instrument other than the strings corresponding to the diatonic scale for a particular key. With a set of several auxiliary dampers, the chromatic instrument can be converted to play in any one of several diatonic keys.

Further objects, advantages, and details of the invention will be apparent from the following detailed description, when read in conjunction with the drawings.

DETAILED DESCRIPTION

Figure 1:
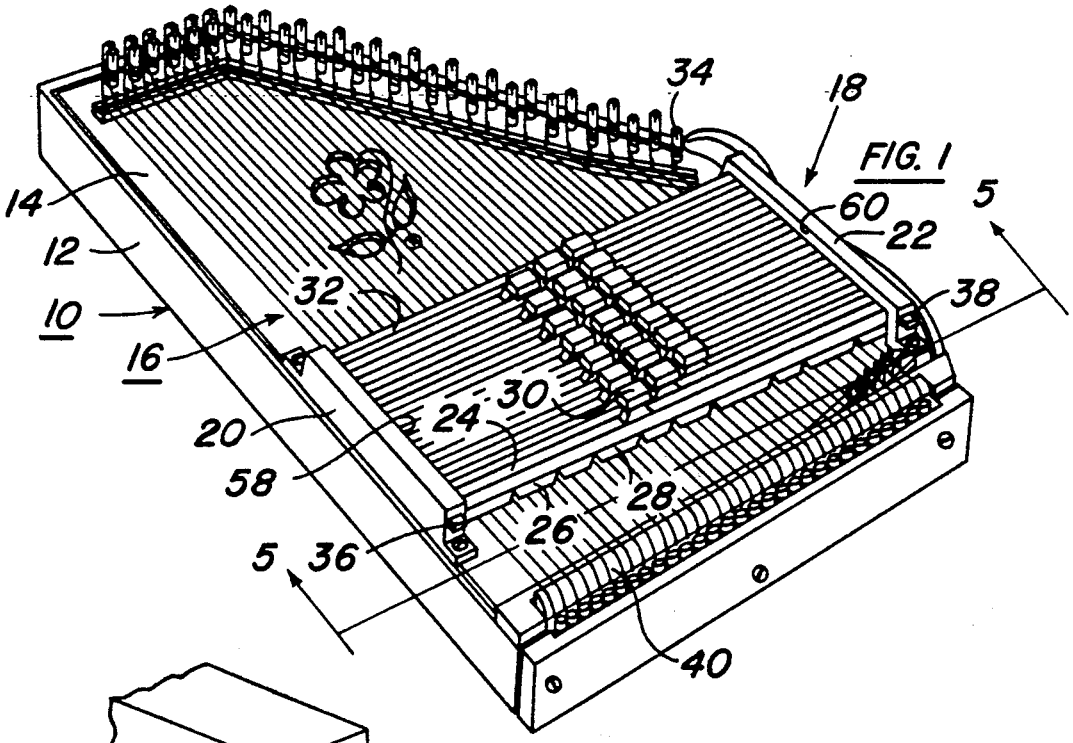
FIG. 1 is a perspective view of a first type of chorded zither, modified in accordance with the invention with a pair of overhanging, damper-retaining, projections to accommodate an auxiliary damper.

FIG. 1 shows a chorded zither 10 of the twenty-one bar chromatic type, as made by Orthey Instruments, RD 1, Box 34A, Newport, Pennsylvania, 17074. The instrument comprises a hollow body 12 having a resonating face 14 across which are stretched a series of strings 16, tuned to the notes of the chromatic scale. A typical instrument has thirty six strings, encompassing three full octaves.

A chord bar assembly 18 comprises an array of twenty one chord bars supported in a chord bar housing comprising two end blocks 20 and 22 secured to the body of the instrument against resonating face 14. Each chord bar, e.g. bar 24 has a series of felt pads on its underside, e.g. pads 26 and 28, for damping strings selectively when the chord bar is moved toward the strings by manual depression of the chord bar operation button, e.g. button 30. The end blocks contain guides (not shown) for the chord bars, and spring assemblies (not shown) which normally maintain the pads of the chord bars spaced from the strings..

Depression of a chord bar causes damping of all of the strings of the instrument except for the strings for the notes of the corresponding chord. Thus, for example, depression of the G chord bar causes all strings except for the B, D and G strings to be damped.

The strings of the instrument are plucked or strummed in the area adjacent to chord bar 32. In order to allow the shortest string to be plucked or strummed, the width of the chord bar assembly must be such as to provide space between chord bar 32 and tuning peg 34 for the shortest string. Thus, the width of the chord bar assembly must be significantly less than the length of the shortest string, and the number of chord bars is limited accordingly.

Figure 1A:
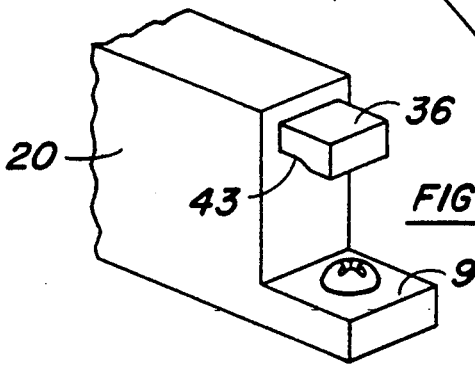
FIG. 1A is a fragmentary perspective view showing the details of one of the damper-retaining projections in the instrument of FIG. 1.

So far, what has been described is a conventional chorded zither. In the improved version of the instrument according to the invention, end blocks 20 and 22 are provided with overhanging, bar-retaining projections, 36 and 38 respectively, on the ends of the blocks nearest the bridge 40. Projection 36, as shown in FIG. 1A overhangs the foot 42 of end block 20, and its underside has a recess 43 for receiving an end of an auxiliary damper bar. Projection 38 has a similar configuration.

Figure 2:
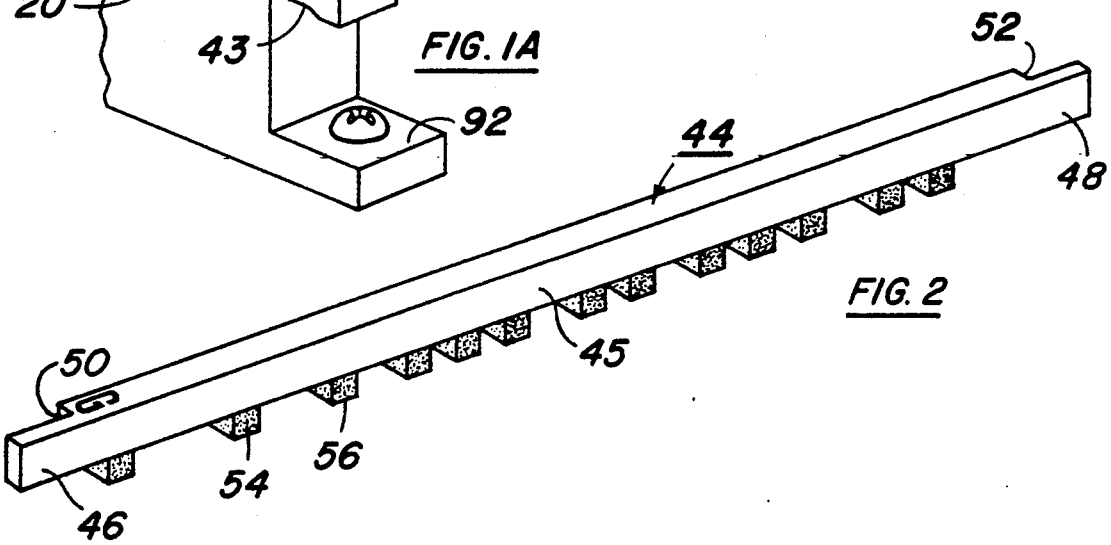
FIG. 2 is a perspective view of a damper, in accordance with the invention, for use with the instrument of FIG. 1.

An auxiliary damper bar 44, as shown in FIG. 2, comprises a rigid member of wood, metal, plastic or similar material 45 preferably having a uniform rectangular cross-section throughout most of its length, and having projections 46 and 48 at its opposite ends, with reduced cross-sectional depth, so that oppositely facing end surfaces 50 and 52 are formed at the ends of the main body of bar 46. Damper pads, e.g. 54 and 56, of felt, sponge rubber, or similar material capable of deadening the vibration of a musical wire string, are secured to the underside of bar 44 at appropriate intervals.

Figure 5:
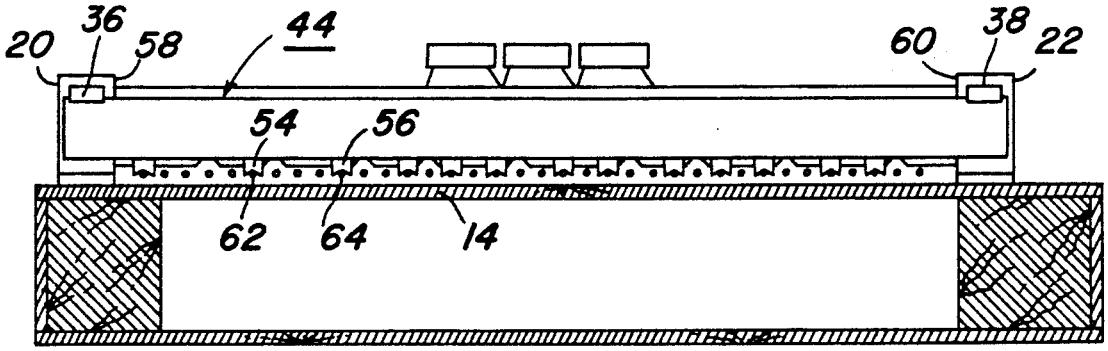
FIG. 5 is a cross-sectional view of the instrument of FIG. 1, taken on plane 5—5 in FIG. 1, showing the instrument with the damper of FIG. 2 in place.

The spacing between surfaces 50 and 52 on the bar is only slightly less than the spacing between the opposed surfaces 58 and 60 of blocks 20 and 22 (FIG. 1). Therefore, when the end projections 46 and 48 of the bar are positioned underneath bar-retaining projections 36 and 38 respectively, with the end projections fitting into the recesses on the undersides of the bar-retaining projections, contact between surfaces 50 and 58, and between surfaces 52 and 60 prevents the damper bar 44 from moving longitudinally, and maintains the pads in register with the appropriate strings. The height of bar 46, and the height of its pads are such that, when the bar is in place, as shown in FIG. 5, the pads are in contact with the strings and compressed sufficiently that the end projections 46 and 48 of bar 44 are urged upwardly against the bar-retaining projections 36 and 38 and firmly held in the recesses in the undersides of the bar-retaining projections. As shown in FIG. 5, pads 54 and 56 are in contact with strings 62 and 64 respectively.

The auxiliary damper bar is set in place by first bringing its pads into contact with the strings while the bar is tilted so that the lower part of the portion of the bar between surfaces 50 and 52 is positioned between blocks 20 and 22. The bar is then pressed downward, compressing the pads, and is rotated until end projections 46 and 48 are in position underneath the recesses on the underside of the bar-retaining projections 36 and 38. The bar is released, and the force exerted by the compressed pads urges the bar firmly into contact with the undersides of the retaining projections. The bar may be removed by pressing it downward and then rotating it so that the upper edges of its end projections 46 and 48 move out from underneath the overhanging bar-retaining projections 36 and 38.

As shown in FIG. 2, bar 44 is labelled "G". Its pads are positioned so that the strings which are damped are those strings unnecessary to the diatonic scale in the key of G. Thus, the A#, C#, D#, F and G# strings are damped, and the C, D, E, F#, G, A and B strings are left open. Other auxiliary damper bars having different pad configurations may be readily substituted for bar 44 to enable the instrument to be played in diatonic style in different keys.

Figure 3:
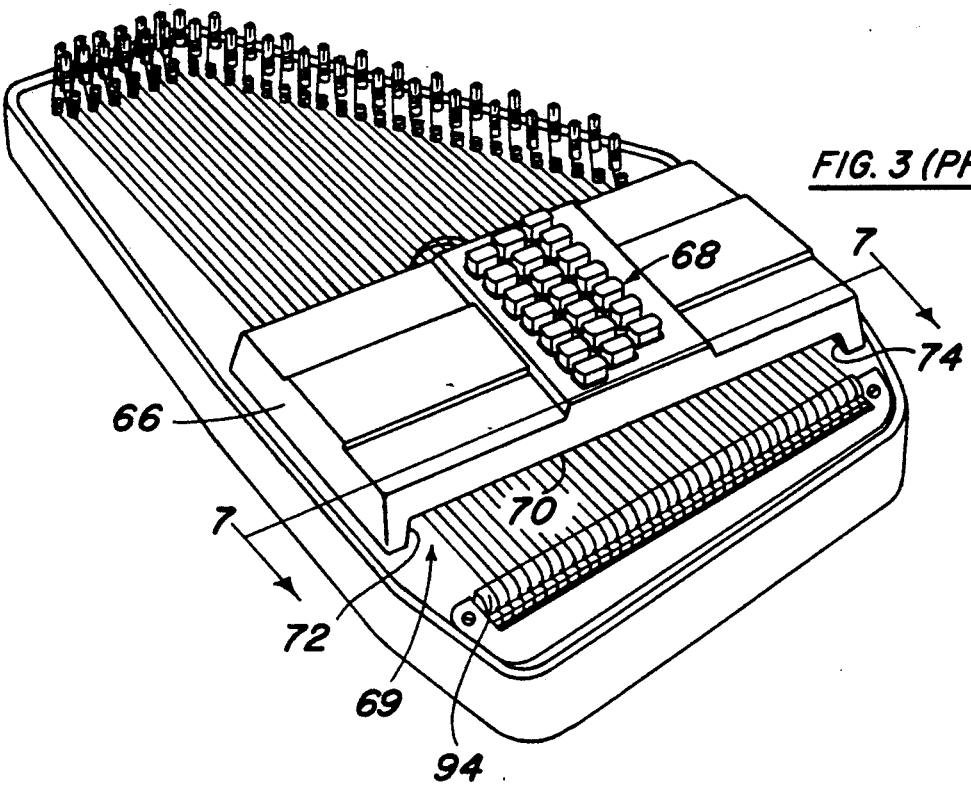
FIG. 3 (PRIOR ART)
FIG. 3 is a perspective view showing a second type of chorded zither in accordance with the prior art.

FIG. 3 shows a conventional twenty-one bar chorded zither of the kind produced by Oscar Schmidt-International, Inc. of Buffalo Grove, Il. In the instrument of FIG. 3, the chord bars (not shown) are housed underneath a plastic cover 66, and operated by buttons 68.

Figure 6:
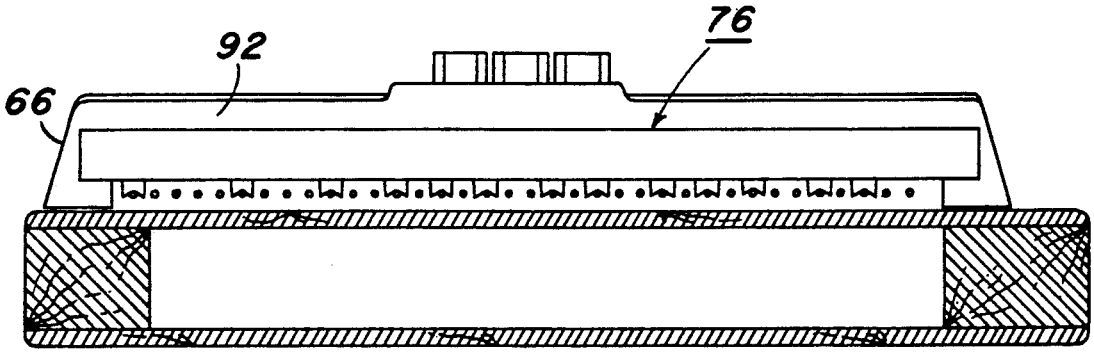
FIG. 6 is a cross-sectional view, similar to FIG. 5, showing the damper of FIG. 4 in place on the instrument of FIG. 3.
Figure 7:
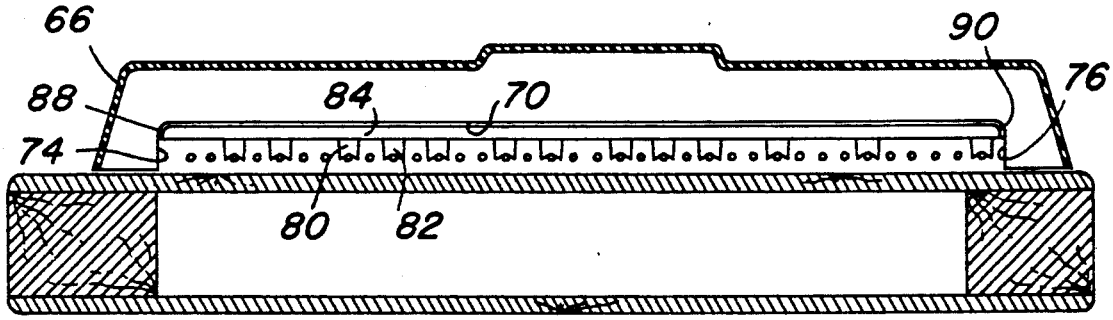
FIG. 7 is a cross-sectional view taken on plane 7—7 of FIG. 3, showing the manner in which the damper of FIG. 4 is held in place.

The plastic cover 66 has an opening 69 defined by a horizontal edge 70 and side edges 72 and 74. A specially designed auxiliary damper bar 76, shown in FIG. 4 comprises an elongated bar 78 having a generally rectangular cross-section, and having damping pads, e.g. pads 80 and 82, disposed at appropriate positions along its underside. A tongue 84, extending along the lower edge of side 86 of the bar is dimensioned so that it fits closely underneath edge 70 of opening 69, with one end 88 of the tongue in close proximity to side edge 74 of the opening, and the opposite end 90 of the tongue in close proximity to side edge 72 of the opening, as shown in FIG. 7. The tongue 84 is positioned relative to the pads so that, when the auxiliary damper bar is in place as shown in FIG. 7, the pads are in engagement with their corresponding strings and compressed so that an upward force is exerted on the bar sufficient to hold tongue 84 in engagement with edge 70 of the opening of the plastic chord bar cover, thereby maintaining the auxiliary damper bar firmly in position. Engagement of ends 88 and 90 of tongue 84 with edges 74 and 76 respectively of the opening of the chord bar cover, prevents longitudinal movement of the bar. The side 86 (FIG. 4) of the bar is in contact with outside face 92 of cover 66, as shown in FIG. 6, so that the bar is stabilized against movement in the direction toward the tuning pegs of the instrument. Preferably, the damper bar and its pads are made sufficiently wide that the bar does not tend to tilt either toward or away from the chord bar housing. Alternatively, side 86 of the damper bar can be slanted so that it conforms to slope of face 92 of chord bar cover 66 (FIG. 6). Friction prevents the bar from moving toward the bridge 94 (FIG. 3).

The damper bar of FIGS. 3, 4, 6 and 7 functions in substantially the same manner as the bar of FIGS. 2 and 5. Installation and removal of the bar take place in a slightly different manner, in that bar 76 is installed by pressing it downward against the strings, sliding it laterally, without rotation, until tongue 84 enters opening 69, and then releasing the downward pressure on the bar. Removal of the bar is accomplished by applying downward pressure, sliding the bar in the direction toward the bridge, and then removing the bar from the strings. Again, the instrument may be provided with several auxiliary damper bars so that it can be played, in diatonic style, in any selected one of several keys.

Figure 4:
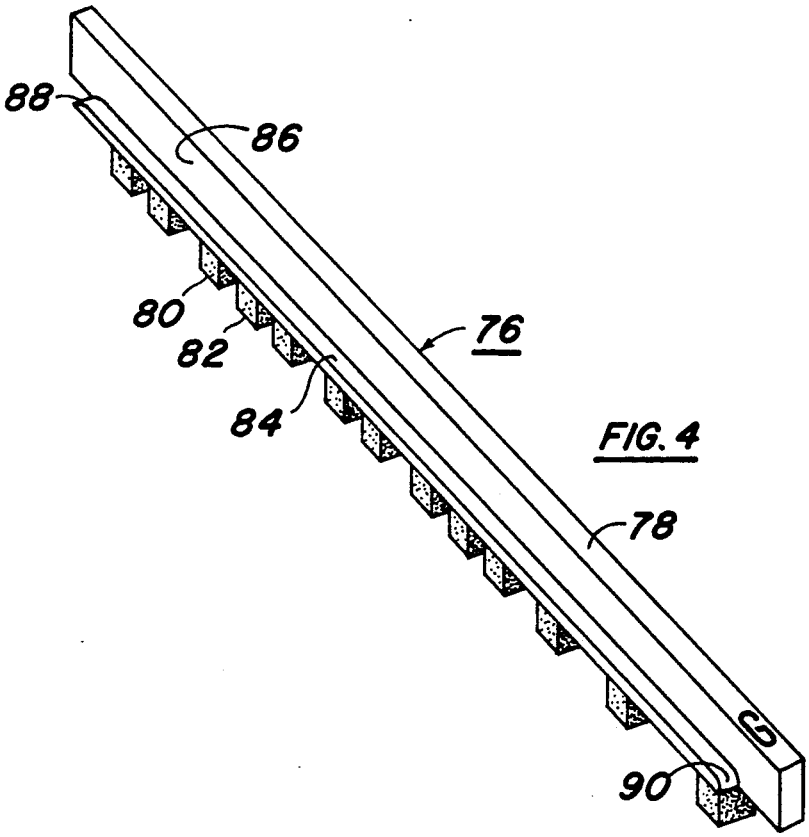
FIG. 4 is a perspective view of a damper bar, in accordance with an alternative embodiment of the invention, designed for use with the instrument of FIG. 3.

The instrument of FIG. 3 requires no modifications in order to make use of the auxiliary damper bar of FIG. 4.

The use of the auxiliary damper bar in accordance with the invention has many advantages over earlier methods of conversion from chromatic to diatonic tuning. Most importantly, the invention allows the musician to employ chromatic and diatonic playing techniques with a single instrument, without reduction of the number of chord bars available on the instrument. It also has the advantage that it allows the musician to change rapidly from one configuration to another by adding or removing a damper bar, or by removing one damper bar and substituting another. Changing from one key to another can be accomplished in a short time during a concert performance, between songs, using only one hand to make the change.

Various modifications can be made within the scope of the invention to the instruments described. Examples of modifications are described below.

In accordance with a first modification, to insure that the pads of the auxiliary damper bar are properly aligned with the strings, posts can be provided on the face of the instrument at positions such that, when the damper bar is in place, it is located between the posts and prevented by the posts from moving longitudinally.

A second modification is a version of the instrument in which the auxiliary damper bar is held underneath metal hooks having shanks in the form of wood screws, which are threaded into the body of the instrument at locations adjacent to the chord bar housing. For alignment of the pads of the damper bar with the strings, the upper edge of the damper bar may be provided with notches to receive overhanging portions of the hooks.

In the case of an instrument in which the chord bar housing consists of molded plastic blocks, the damper bar retainers can be integrally molded parts of the blocks. Similarly, where the chord bar housing consists of wooden blocks, the retainers can be unitary parts of the blocks, formed by milling. Where an instrument already manufactured is being retrofitted, however, the retainers will normally be separate parts secured to the chord bar housing or to the body of the instrument by metal fasteners, or by other wood joining techniques, for example dovetail joining.

The damper bar may, of course, be located on the bridge side of the chord bar assembly, or alternatively on the tuning peg side, and appropriate bar retainers may be provided on either or both sides of the chord bar housing. The damper pad configuration will differ, depending on the side of the chord bar housing on which the auxiliary damper bar is to be placed.

The damper bars, which will ordinarily be available in sets, for example a set of six bars for use with a twenty one bar chromatic chorded zither, may be marked with appropriate key designations in Braille for visually impaired musicians.

The invention, is of course applicable to chorded zithers having various numbers and arrangements of chord bars, and is not limited to the standard configuration of chord bars found on a twenty one bar instrument. In a non-conventional chord bar arrangement, for example, as many as ten or more diatonic keys could be made available in addition to the chromatic scale, so that the instrument could be effectively eleven or more instruments in one.

Various other modifications can be made to the instruments described herein without departing from the scope of the invention as defined in the following claims.

We claim:

1. In a chorded zither comprising a body having a resonating face, a set of parallel strings stretched across said resonating face and tuned to a chromatic scale, and an assembly of individual depressible chord bars, each having multiple pads for selectively muting groups of said strings when each chord bar is depressed, the improvement comprising at least one auxiliary damper comprising a rigid bar having string-engaging damping pads mounted thereon, and mounting means for removably mounting said auxiliary damper on the chorded zither alongside one of said chord bars with the damping pads of said auxiliary damper held by said mounting means in engagement with predetermined strings of said set and arranged in a pattern to mute all of the strings corresponding to notes of the chromatic scale other than the strings corresponding to notes of a particular diatonic scale.

2. A chorded zither according to claim 1 having a housing for supporting the chord bars, and in which the means for removably mounting said auxiliary damper comprises a pair of overhanging projections extending from said housing in substantially parallel relationship to the strings, the rigid bar of the auxiliary damper having ends positionable underneath, and engageable with, said overhanging projections, and the overhanging projections being positioned such that, when the ends of said rigid bar are underneath and engaged with said overhanging projections, the string-engaging damping pads of said auxiliary damper are held in engagement with strings of said set.

3. A chorded zither according to claim 1 having a housing for supporting the chord bars, and in which the means for removably mounting said auxiliary damper comprises a pair of overhanging projections extending from said housing in substantially parallel relationship to the strings, the rigid bar of the auxiliary damper having ends positionable underneath, and engageable with, said overhanging projections, the overhanging projections being positioned such that, when the ends of said rigid bar are underneath and engaged with said overhanging projections, the string-engaging damping pads of said bar are held in engagement with strings of said set, and the rigid bar and said housing also having means comprising cooperating, mutually engageable surfaces, for preventing longitudinal movement of said auxiliary damper bar, thereby insuring that, when the auxiliary damper is mounted on the zither with the ends of its rigid bar held underneath said overhanging projections, the string-engaging damping pads of the auxiliary damper are in engagement with predetermined strings.

4. A chorded zither according to claim 1 having a housing for supporting the chord bars, said housing having an elongated opening through which said strings extend, the opening being defined by a top edge and a pair of side edges, in which the string-engaging damping pads of said auxiliary damper are mounted on a bottom face of said rigid bar, and in which the rigid bar has a side face having a lower edge, and an elongated tongue extending along said lower edge and extending laterally therefrom, the tongue having a length substantially equal to a distance between said side edges of the opening and being engageable with said top edge of the opening, the height of the pads of the auxiliary damper being such that the pads are in contact with the strings, and compressed thereby, when the tongue is in contact with said lower edge of the opening.

5. In a chorded zither comprising a body having a resonating face, a set of parallel strings stretched across said resonating face and tuned to a chromatic scale, and an assembly of individually depressible chord bars, each having multiple pads for selectively muting groups of said strings when each chord bar is depressed, the improvement comprising a set of auxiliary dampers, each comprising a rigid bar having string-engaging damping pads mounted thereon, and mounting means for removably mounting any selected one of said auxiliary dampers on the chorded zither alongside one of said chord bars with the damping pads of said selected auxiliary damper held by said mounting means in engagement with predetermined strings of said set, each auxiliary damper corresponding to a different key, and the damping pads of each auxiliary damper being arranged in a pattern to mute all of the strings corresponding to notes of the chromatic scale other than the strings corresponding to notes of a diatonic scale for each of said different keys.

6. An auxiliary damper for a chorded zither comprising a rigid bar having string-engaging damping pads mounted thereon, means on said bar for removably securing said bar to a chord bar housing of a chorded zither with said string engaging pads in engagement with predetermined strings of said zither, the damping pads of the auxiliary damper being arranged in a pattern to mute all of the strings of the zither corresponding to notes of a chromatic scale other than the strings corresponding to notes of a diatonic scale in a particular key.

7. An auxiliary damper according to claim 6 in which the damping pads are mounted on a bottom face of said rigid bar, and in which the rigid bar has a side face having a lower edge, and an elongated tongue extending along said lower edge of the side face and extending laterally therefrom.

* * * * *